United States Patent [19]

Idel et al.

[11] 4,152,161

[45] May 1, 1979

[54] PHOTOGRAPHIC SILVER HALIDE EMULSION WITH HETERO-N CONTAINING POLYMERIC BINDER

[75] Inventors: Karsten-Josef Idel, Krefeld; Wilhelm Saleck, Schildgen; Erich Wolff, Leverkusen; Dieter Freitag, Krefeld, all of Fed. Rep. of Germany

[73] Assignee: AGFA-Gevaert, A.G., Leverkusen, Fed. Rep. of Germany

[21] Appl. No.: 659,702

[22] Filed: Feb. 20, 1976

[30] Foreign Application Priority Data

Feb. 26, 1975 [DE] Fed. Rep. of Germany ..... 2508279

[51] Int. Cl.[2] ..... G03C 1/72

[52] U.S. Cl. ..... 96/114; 96/88

[58] Field of Search ..... 96/114, 88

[56] References Cited

U.S. PATENT DOCUMENTS 3,813,251 5/1974 Hollistu et al. ..... 96/114

3,926,869 12/1975 Horie et al. ..... 96/114

3,957,492 5/1976 Miyazako et al. ..... 96/114

*Primary Examiner*—John D. Welsh

[57] ABSTRACT

A copolymer containing 0.1 to 20 mol-% of recurring structural units of the formula

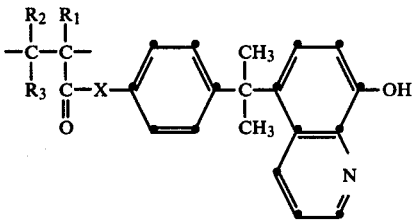

is a valuable peptising agent for the precipitation of silver halide. Sensitivity, onset of development and silver coating power are advantageously influenced.

3 Claims, No Drawings

PHOTOGRAPHIC SILVER HALIDE EMULSION WITH HETERO-N CONTAINING POLYMERIC BINDER

This invention relates to a photographic silver halide emulsion with increased sensitivity which contains new polymers as sensitivity increasing additives.

The sensitivity of a photographic silver halide emulsion to light can be influenced in two ways. Firstly, the sensitivity can be increased by suitable choice of the physical conditions under which precipitation and the so-called physical ripening of the silver halide is carried out. In practice, there is a limit to the results which can be obtained in this way because the increase in sensitivity is accompanied by an increase in the silver halide grain size which deleteriously affects the quality of the final image. What is desired is a silver halide emulsion with a very high sensitivity and fine grain.

Secondly, the sensitivity of photographic emulsions can be increased chemically by the addition of compounds generally known as chemical sensitisers.

In principle, these compounds may be added at any stage of the preparation of the emulsion, for example they may be added as ripening additives before chemical ripening is carried out or they may be added to the finished casting solution after chemical ripening. Suitable ripening additives include, for example, noble metal salts, in particular gold salts, and sulphur compounds such as thiosulphates or organic, particularly heterocyclic sulphur compounds. One disadvantage of chemical sensitisation is that the increase in sensitivity is accompanied by an increased tendency of the emulsion to form a uniform developable fog. For this reason, very powerful chemical sensitisers such as compounds with an onium structure, e.g. quaternary ammonium and phosphonium salts or ternary sulphonium salts or polyalkylene oxides and polyalkylene oxide derivatives may only be added to the finished casting solution after chemical ripening. If the substances were added before chemical ripening, the photographic silver halide emulsions would be so heavily fogged that they could no longer be used.

Sensitivity increasing additives may also be added during the precipitation of the silver halide, or precipitation may be carried out in the presence of such additives. Most of the chemical sensitisers, however, are unsuitable for this purpose for the reasons mentioned above, that is to say they either do not sensitise sufficiently or produce an excessively heavy fog.

Precipitation of the silver halide is generally carried out in the presence of gelatine, which has proved to be a particularly suitable binder for this purpose (peptisation agent) on account of its advantageous properties as a dispersing agent and protective colloid. In addition, gelatine acts as halogen acceptor in the photographic process and has excellent gel-forming properties as well as other advantageous properties which have led it to become the preferred binder for photographic silver halide emulsions.

However, it is difficult to produce gelatine of consistent quality and with constant physical and photographic properties. Most of its properties deteriorate in storage due to bacterial decomposition or in the photographic process due to hydrolysis. Furthermore, gelatine contains varying quantities of many different naturally occurring impurities, depending on its origin, and while some of these may have an advantageous effect, others may be harmful. In addition, gelatine is subject to dimensional changes when exposed to varying conditions of temperature and moisture.

Since the photographic properties of a silver halide emulsion depend to a large extent on the precipitation conditions, there have been many attempts to replace gelatine by other suitable peptising agents, in particular by semi-synthetic or fully synthetic substances such as synthetic polymers. On the whole, no substantial improvements could thereby be achieved. Thus for example phthalated gelatine as described in U.S. Pat. No. 2,614,928 has similar disadvantages to those of gelatine itself. Although polyvinyl pyrrolidone and polyvinyl alcohol are suitable as protective colloids, they considerably inhibit the growth of the grain. Copolymers of acrylamide and its derivatives have also been proposed as peptisation agents as described in U.S. Pat. No. 2,811,494. It is difficult, however, to produce synthetic materials which are comparable to gelatine in their protective colloid action and stable to the pH changes inevitably occurring during preparation of the emulsion as well as being compatible with gelatine. Although most of the synthetic polymers described have a positive influence on certain mechanical properties such as, for example, the dimensional stability of the film and the swelling properties, this is usually achieved at the expense of the relationship between the sensitivity and the fineness of grain of the photographic materials. Moreover, the monomers required for the preparation of some of the polymers proposed can only be obtained by complicated, multi-stage processes.

It is an object of this invention to provide a binder for photographic silver halide emulsions which is suitable as peptising agent and therefore capable of partly or completely replacing gelatine in the precipitation process. The new binder should increase the sensitivity of the photographic silver halide emulsions without substantially coarsening the grain. It should also improve the onset of development of the emulsion (lower induction period) and the covering powder of the silver produced by development.

This invention relates to a light-sensitive photographic silver halide emulsion which is characterised by containin a copolymer with recurrent structural units of the following formula

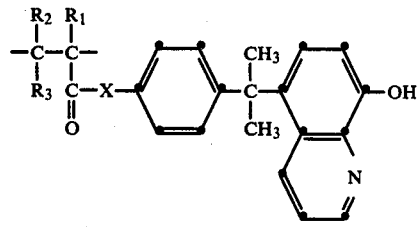

in which

X represents —O— or —NH—;

$R_1$ represents hydrogen or an alkyl group preferably with 1 to 4 carbon atoms, more preferably a methyl group;

$R_2$ represents hydrogen or an alkyl group preferably with 1 to 4 carbon atoms, more preferably a methyl group;

$R_3$ represents hydrogen or a —COOH or —$COOR_4$ group;

$R_4$ represents an alkyl group with 1 to 8 carbon atoms, e.g. a methyl, n-butyl, or n-octyl group or a cycloalkyl group such as a cyclohexyl group.

Copolymers of this kind have a controlling influence on the growth of the silver halide grain, for example they may inhibit it. Their influence may vary according to the nature of the silver halide (chloride or bromide) and can be adjusted as desired within certain limits by suitable choice of the proportion of 8-oxiquinoline-containing monomers in the mixture of comonomers. The proportion in which the 8-oxiquinoline monomers, which determine the properties, is present in the comonomer mixture and hence the proportion of recurrent structural units of the above formula in the copolymer may range from 0.1 to 20 mol-% and is preferably between 0.1 to 10 mol-%.

The most suitable comonomers are mainly water-soluble compounds, for example polymerisable compounds which contain carboxy, sulpho or phosphinic acid groups, such as acrylic acid, methacrylic acid, vinyl sulphonic acid, styrene sulphonic acid, allyl sulphonic acid, methallyl sulphonic acid, acrylamido-2-methyl-propane sulphonic acid and salts of the above mentioned acids or vinyl pyridine, N-vinyl pyrrolidone, vinyl methyl etter, acrylamide or methacrylamide.

In some cases it may be advantageous to incorporate a limited quantity, for example up to 20 mol-% of other, less water-soluble polymerisable monomers to produce certain effects, for example to modify the elasticity and swelling properties. Acrylonitrile, acrylic acid esters and N-substituted acrylamides or methacrylamides are examples of such comonomers.

The molecular weight of the polymers used according to the invention is generally from 10,000 to 1,000,000. If the molecular weight is too low, the viscosity of the emulsion while it is being prepared is too low and the protective colloid action is generally unsatisfactory. On the other hand, too high a molecular weight may reduce the compatibility with other binders, for example with gelatine. It is particularly preferred to use a copolymer with a molecular weight within the range of 50,000 to 500,000.

The present invention also relates to a process for the preparation of a photographic silver halide emulsion by the precipitation and physical ripening of the silver halide in the presence of a peptisation agent, followed by flocculation of the emulsion, washing if necessary, redispersion and chemical ripening, characterised in that precipitation of the silver halide is carried out in the presence of a copolymer which contains up to 20 mol-% of recurrent structural units of the formula indicated above.

Copolymers which contain structural units obtained by copolymerisation with acrylamide, and/or acrylic acid and if desired up to 20 mol-% of N-vinyl pyrrolidone in addition to the structural units of the above formula have proved to be particularly useful.

The preparation of the monomers and the copolymers has been described in German Offenlegungsschrift No. 2,407,307 The monomers contain a polymerisable double bond and can be homopolymerised or copolymerised by the usual methods of solvent-free, solution or emulsion polymerisation, but the most suitable methods for the preparation of photographic binders are solution polymerisation and emulsion polymerisation. The temperature at which the polymers of the present invention are prepared may vary within wide limits since it depends on various factors such as, for example, the specific monomers used, the reaction time and the initiator system. The polymerisation temperature generally does not exceed 110° C. and is in most cases between 50 and 100° C. Polymerisation may be carried out in a suitable medium, for example in water or in mixtures of water and water miscible solvents such as methanol, ethanol, propanol, isopropanol or butyl alcohol. The concentration of the polymerisable monomers in the polymerisation mixture may vary considerably, satisfactory results being generally obtained with concentrations of 10 to 40% by weight, based on the whole polymerisation mixture. Examples of suitable catalysts include compounds which release free radicals, for example per compounds such as persulphate, porofores, i.e. azo compounds which are decomposed by heat such azodiisobutyronitrile(=Porofor N; Porofor is a trade mark) or Redox polymerisation systems. Reference may be had in this connection to Houben-Weyl, Methoden der organischen Chemie, 4th edition, 1961, volume XIV/1, page 209 et. seq. It may in some cases be indicated to add a regulator to control the molecular weight, for example a lower molecular weight can be obtained by increasing the quantity of isopropanol added. The polymers can be isolated from the reaction mixture in known manner by freezing, salting out, precipitation or any other suitable method.

Some examples of preparation of the polymers used according to the invention are given below.

Polymer 1

5 ml of 20% sodium hydroxide solution are added slowly with stirring to a solution of
4 g of 2-[4-methacryloyloxyphenyl]-2-[5-(8-hydroxyquinolyl)]-propane in
40 ml of ethanol
4 g of freshly distilled acrylic acid and a solution of
88 g of acrylamide in 200 ml of waterethanol (1:1) are then added. The reaction mixture is vigorously flushed with nitrogen, and a solution of
0.7 g of potassium persulphate in the minimum quantity of water is added. The reaction mixture is then stirred for 3 hours at 80° C. After cooling, the upper layer is decanted and the precipitated product is purified by repeatedly dissolving it in sodium hydroxide solution and precipitating it with acetic acid. The purified product is used to prepare a solution in water with a solid content of 13.5%. At an alkaline pH, the aqueous solution has the intense yellow colour of the oxinate anion.

Polymer 2

A copolymer of
2 g of 2-[4-methacryloyloxyphenyl]-2-[5-(8-hydroxyquinolyl)]-propane,
4 g of acrylic acid and
88 g of acrylamide is prepared in a corresponding manner.

Polymer 3

A copolymer of
1 g of 2-[4-methacryloyloxyphenyl]-2-[5-(8-hydroxyquinolyl)]-propane,
4 g of acrylic acid and
88 g of acrylamide is prepared in a corresponding manner.

Polymer 4

110.5 g of acrylic acid amide, 7.10 g of N-vinyl pyrrolidone and
2.4 g of 2-[4-methacryloyloxyphenyl]-2-[5-(8-hydroxyquinolyl)]-propane are dissolved in
360 g of ethanol at 70° C., and a solution of
5.76 g of a 50% benzoyl peroxide paste in 100 ml of benzene is added dropwise over a period of 3 hours. The reaction is left to continue for a further 20 minutes and the white polymer formed in the reaction is filtered off. The yield is 126 g Polymer 5

A terpolymer is prepared in a similar manner to example 4 from
108.8 g of acrylic acid amide,
7.0 g of N-vinyl pyrrolidone and
4.2 g of 2-[4-methacryloyloxyphenyl]-2-[5-(8-hydroxyquinolyl)]-propane.

Polymer 6

A terpolymer is prepared in a similar manner to example 4 from
107.2 g of acrylic acid amide,
7.8 g of N-vinyl pyrrolidone and
6 g of 2-[4-methacryloyloxyphenyl]-2-]5-(8-hydroxyquinolyl)]-propane.

The polymers to be used according to the invention are added to the photographic silver halide emulsion before its chemical ripening, preferably at the precipitation stage. The quantity to be added depends on the desired effect and can be determined by a few simple tests in the usual manner. The binder used as protective colloid for the precipitation of the silver halide may, for example, consist to an extent of 10 to 100% by weight of the polymer according to the invention and the remainder of the binder may consist of gelatine. The polymers according to the invention are generally used in in quantities of from 500 mg to 500 g, preferably 1 g to 200 g, per mol of silver halide to be precipitated. The compounds used in accordance with the invention are added in the form of their aqueous solutions. Their concentration in the solution is not critical and may vary within wide limits. The polymers must be sufficiently water-soluble to enable a sufficiently concentrated aqueous solution to be prepared. It is sufficient, for example, to use a 1 to 5% aqueous solution but more concentrated solutions may, of course, by used if the compounds are exceptionally soluble. The solutions are generally adjusted to a pH of about 7 although they may be kept at a slightly acid pH, for example a pH 5 to 7, or in the case of so-called ammoniacal emulsions the pH of the solution may lie between 5 and 9.

The polymers are synthetic products of consistent quality. They are surprisingly found to produce a considerable increase of sensitivity without substantially coarsening the silver halide grain. Other advantages include the rapid onset of development of the silver halide emulsions and in some cases the increased covering power of the silver produced by development.

The compounds according to the invention may be used in any silver salt emulsions, preferably silver halide emulsions. The silver halides may be silver chloride, silver bromide or mixtures thereof, which may have a small silver iodide content of up to 10 mol-%. The silver halides may be dispersed in the usual hydrophilic binders, for example in carboxymethyl cellulose, polyvinyl alcohol polyvinyl pyrrolidone, alginic acid and its salts, esters or amides or in proteins, preferably in gelatine.

The emulsions may also contain other chemical sensitisers, e.g. quaternary ammonium and phosphonium salts and ternary sulphonium salts, reducing agents such as tin-II salts, polyamines such as diethylene triamine or sulphur compounds as described in U.S. Pat. No. 1,574,944. The emulsions may also contain chemical sensitisers in the form of salts of noble metals such as rhuthenium, rhodium, palladium, iridium, platinum or gold as described in the article by R. Koslowsky, Z. Wiss. Phot. 46, 65 to 72 (1951). The emulsions may also contain polyalkylene oxides or polyalkylene oxide derivatives as development accelerators or chemical sensitisers which produce an additional gain in sensitivity.

The emulsions may be spectrally sensitised, for example with the usual monomethine or polymethine dyes such as acid or basic cyanines, hemicyanines, streptocyanines, merocyanines, oxonols, hemioxonols, styryl dyes or others, including also trinuclear or higher nuclear methine dyes, for example rhodacyanines or neocyanines. Sensitisers of this kind have been described, for example, in the works by F. M. Hamer "The cyanine Dyes and Related Compounds" (1964), Interscience Publishers John Wiley and Sons.

The emulsions may contain the usual stabilisers, e.g. homopolar or salt-type compounds of mercury which contain aromatic or heterocyclic rings (for example mercaptotriazoles), simple mercury salts, sulphonium mercury double salts and other mercury compounds. Azaindenes are also suitable stabilisers, particularly tetra- or pentaazaindenes and especially those which are substituted with hydroxyl or amino groups. Compounds of this kind have been described in the article by Birr, Z. Wiss. Phot. 47, 2–27 (1952). Other suitable stabilisers include heterocyclic mercapto compounds, e.g. phenyl mercaptotetrazole, quaternary benzothiazole derivatives, benzotriazole and the like.

The emulsions may be hardened in the usual manner, for example with formaldehyde or halogenated aldehydes which contain a carboxyl group, such as mucobromic acid, diketones, methane sulphonic acid esters, dialdehydes and the like or polyfunctional triazine derivatives such as trisacryloyl hexahydrotrizine or halogenated or alkoxy-substituted hexahydrotriazine derivatives.

The compounds according to the invention exert their advantageous effect not only in black and white emulsions but also in the production of colour photographic images. They have good compatibility with the usual colour couplers. The polymers may also be used in direct positive emulsions, for example those with a layered grain structure described in French Pat. No. 1,585,791. They are also suitable for the silver dye bleaching process or the dye diffusion process.

The polymers produce a particularly advantageous effect in silver halide emulsions which are precipitated in the presence of silicate sols. The preparation of such emulsions has been described in German Offenlegungsschrift No. 1,797,254 and in U.S. Pat. No. 3,637,391.

According to another preferred embodiment of the invention, the polymers are used in combination with polymers which contain disulphonimide groups. These compounds have been described in German Pat. No. 1,089,548 and in U.S. Pat. No. 3,052,656. The disulphonimide polymers are added before chemical ripening, in particular at the sage of precipitation of the flocculate. The concentration of disulphonimides may vary within wide limits but it has generally been found sufficient to use from 1 to 10%, based on the whole quantity of binder during the precipitation process.

EXAMPLE 1

Sample 1

The following solutions were prepared by producing a silver iodobromide gelatine emulsion:

| | | |
|---|---|---|
| Solution A) | 1000 ml of water | |
| | 10 g of gelatine | |
| | 30 g of KBr | |
| | 2 g of KI | temperature 50° C. |
| Solution B) | 1000 ml of water | temperature 45° C. |
| | 40 g of $AgNO_3$ | |

Solution B was poured steadily into solution A within 5 minutes and the mixture was then digested for 30 minutes at 50° C. and cooled to 20° C. 10 ml of a 10% aqueous polystyrene sulphonic acid solution were added and the emulsion was flocculated by lowering the pH to 3.0 with sulphuric acid (25%). The flocculate was left to settle ripening, the flocculate was dissolved in 2000 ml of a 10% aqueous gelatine solution (pH 7.5) at 40° C.

After the flocculate had been dissolved, the pH was adjusted to 6.5 and the appropriate quantity of ripening agents in the form of sulphur compounds and gold salts was added and the solution was ripened to ful sensitivity at 55° C. 10 ml of a 5% aquous solution of formaldehyde (hardener) and 20 ml of a 1% methanolic solution of 4-hydroxy-6-methyl-1,3,3a,7-tetraazaindene (stabiliser) were added per kg of emulsion and the mixture is cast on a cellulose acetate substrate. The emulsion was sensitometrically assessed after exposure in a conventional sensitometer behind a step wedge and development (7 and 16 minutes at 20° C.) in a developer of the following composition:

Sodium sulphite sicc.—70.0 g
borax—7.0 g
hydroquinone—3.5 g
p-monomethyl aminophenol sulphate—3.5 g
sodium citrate—7.0g
potassium bromide—0.4 g made up with water to 1 liter.

Samples 2–7

Preparation of the emulsion and assessment were carried out in the same way but 50% of the gelatine in solution A was replaced in each case by the same weight of one of the polymers 1 to 6 described above.

Table 2 shows that emulsions 2 to 7 (containing polymers 1 to 6) were more sensitive than the comparison emulsion.

Table 1

| Sample | 7 minutes development | | | 16 minutes development | | |
|---|---|---|---|---|---|---|
| | Sensitivity °C. | γ | Fog | Sensitivity °C. | γ | Fog |
| 1 | Blank | 1,10 | 0,05 | Blank | 1,25 | 0,06 |
| 2 | +1,5 | 1,25 | 0,10 | + 2,0 | 1,30 | 0,14 |
| 3 | +1° | 1,10 | 0,11 | + 1,0 | 1,30 | 0,16 |
| 4 | +1,5 | 1,10 | 0,07 | + 2,0 | 1,25 | 0,10 |
| 5 | + 2° | 1,05 | 0,05 | + 1,5 | 1,20 | 0,07 |
| 6 | + 1,5 | 1,15 | 0,05 | + 2,0 | 1,25 | 0,06 |
| 7 | + 2,0 | 1,10 | 0,04 | + 2,0 | 1,15 | 0,05 |

3° = 1 shutter stop

EXAMPLE 2

Sample 1

The same silver iodobromide gelatine emulsion as sample 1 of example 1 was prepared as comparison emulsion.

Samples 2–7

These emulsions were prepared in the same way as sample 1 but the *whole* quantity of gelatine in solution A was replaced in each case by an equal weight of one of the polymers 1 to 6 described above.

After precipitation of the silver halide, 10 g of gelatine were added as a 10% aqueous solution and the emulsion was then flocculated by the addition of polystyrene sulphonic acid and reduction of the pH to 3.0 with sulphuric acid. Subsequent treatment was the same as described in Example 1.

Table 2

| Sample | 7 minutes development | | | 16 minutes development | | |
|---|---|---|---|---|---|---|
| | Sensitivity °C. | γ | Fog | Sensitivity °C. | γ | Fog |
| 1 | Blank | 1,10 | 0,07 | Blank | 1,15 | 0,08 |
| 2 | +4° | 0,90 | 0,09 | + 3,5 | 1,00 | 0,11 |
| 3 | +4° | 0,85 | 0,14 | + 4° | 1,00 | 0,18 |
| 4 | +2,5 | 0,95 | 0,08 | + 3° | 1,00 | 0,10 |
| 5 | +3° | 1,00 | 0,07 | + 2,5 | 1,10 | 0,09 |
| 6 | +2,5 | 1,10 | 0,08 | + 2,5 | 1,20 | 0,09 |
| 7 | +4,5 | 0,95 | 0,07 | + 3,5 | 1,05 | 0,09 |

3° = 1 shutter stop

Both tables show the surprising increase in sensitivity, which is greatest when 100% of polymer is used without gelatine.

The field of application is not restricted to the examples given above but can be extended to any type of emulsion and all possible compositions of silver halide.

We claim:

1. In a lightsensitive photographic silver halide emulsion containing silver halide particles dispersed in hydrophilic binder the improvement according to which at least part of the binder consists of a homopolymer with a molecular weight of from 10,000 to 1,000,000 comprising units of the following formula or of a copolymer with a molecular weight from 10,000 to 1,000,000 comprising 0.1 to 20 mol % of units of the following formula

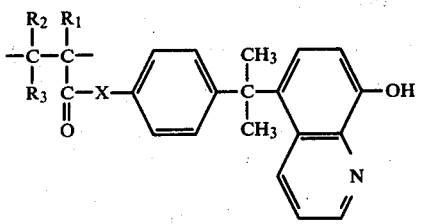

in which

X represents —O— or —NH—, $R_1$ represents hydrogen or alkyl with 1 to 4 carbon atoms, $R_2$ represents hydrogen or alkyl with 1 to 4 carbon atoms, $R_3$ represents hydrogen, —COOH, or $COOR_4$ and $R_4$ represents alkyl with 1 to 8 carbon atoms or cycloalkyl, the remainder of the binder being made up of a protective colloid.

2. Photographic silver halide emulsion as claimed in claim 1, in which the polymer contains 80 to 99.9 mol-% of copolymerised units selected from units of the group consisting of acrylamide, acrylic acid and N-vinyl pyrrolidone.

3. In the process for the preparation of a photographic silver halide emulsion by precipitation and physical ripening of the silver halide in the presence of a peptisation agent, whereupon the emulsion is flocculated, washed if necessary redispersed and chemically ripened, the improvement according to which the precipitation of the silver halide is carried out in the presence of a peptizing agent comprising a homopolymer with a molecular weight of from 10,000 to 1,000,000 comprising units of the following formula or of a copolymer with a molecular weight from 10,000 to 1,000,000 comprising 0.1 to 20 mol % of units of the following formula

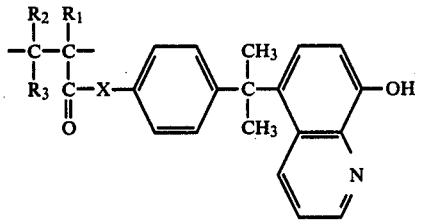

in which

X represents —O— or —NH—, $R_1$ represents hydrogen or alkyl with 1 to 4 carbon atoms, $R_2$ represents hydrogen or alkyl with 1 to 4 carbon atoms, $R_3$ represents hydrogen, —COOH or $COOR_4$ and $R_4$ represents alkyl with 1 to 8 carbon atoms or cycloalkyl, said process being characterised in that 10 to 100% by weight of the binder of the silver halide consists of the peptisation agent consisting of the homopolymer or the copolymer, the remainder of the binder being made up of a protective colloid.

* * * * *